US009839883B2

(12) United States Patent
Smith et al.

(10) Patent No.: US 9,839,883 B2
(45) Date of Patent: Dec. 12, 2017

(54) CHANNEL MIXING APPARATUS

(71) Applicant: Komax Systems, Inc., Huntington Beach, CA (US)

(72) Inventors: Robert Smith, Seal Beach, CA (US); Seungsuk Lee, Anaheim, CA (US); Sameer Kshirsagar, Fountain Valley, CA (US)

(73) Assignee: Komax Systems, Inc., Huntington Beach, CA (US)

( * ) Notice: Subject to any disclaimer, the term of this patent is extended or adjusted under 35 U.S.C. 154(b) by 91 days.

(21) Appl. No.: 15/074,289

(22) Filed: Mar. 18, 2016

(65) Prior Publication Data

US 2017/0266631 A1 Sep. 21, 2017

(51) Int. Cl.
*B01F 5/06* (2006.01)

(52) U.S. Cl.
CPC .... *B01F 5/0606* (2013.01); *B01F 2215/0052* (2013.01)

(58) Field of Classification Search
CPC ..... B01F 5/0606
USPC ..... 366/336–337
See application file for complete search history.

(56) References Cited

U.S. PATENT DOCUMENTS 2,583,135 A * 1/1952 Bakker ..... B28C 5/04 366/336
3,051,453 A * 8/1962 Sluijters ..... B01F 5/0641 138/42
3,498,372 A * 3/1970 Collins ..... F28D 9/0037 165/166
3,620,506 A * 11/1971 So ..... B01F 5/0619 366/337
4,040,256 A * 8/1977 Bosche ..... B01F 5/0617 138/42
4,099,268 A * 7/1978 Luthi ..... B01F 5/061 366/338
4,220,416 A * 9/1980 Brauner ..... B01F 5/0617 366/337
4,296,779 A * 10/1981 Smick ..... B01F 5/0617 138/38
4,374,542 A * 2/1983 Bradley ..... B01F 5/0617 159/28.6
4,496,498 A * 1/1985 Pluss ..... B01J 19/30 165/60
4,497,751 A * 2/1985 Pluss ..... B01D 3/24 261/112.1

(Continued)

FOREIGN PATENT DOCUMENTS

DE 41 20 735 A1 12/1992

*Primary Examiner* — Abbas Rashid
(74) *Attorney, Agent, or Firm* — Bay Area Technology Law Group PC

(57) ABSTRACT

A material distributing and mixing apparatus. A conduit having a fluid inlet and fluid outlet houses a mixing element The mixing element includes rectangular segments forming forward facing V-sections and rearward facing V-sections. The forward facing V-sections form vertical apexes that face an incoming fluid stream while additive inlet ports are positioned proximate thereto. The forward facing V-sections are positioned proximate to the top and bottom surfaces of the conduit while the rearward facing V-sections form apexes which are substantially horizontal, the rearward facing V-sections being positioned proximate the vertically extending side walls of the conduit.

7 Claims, 2 Drawing Sheets

(56) References Cited

U.S. PATENT DOCUMENTS

| | | | | | |
|---|---|---|---|---|---|
| 4,497,752 | A * | 2/1985 | Huber | B01F 5/0616 | 165/60 |
| 4,600,544 | A * | 7/1986 | Mix | B01F 5/0616 | 202/158 |
| 5,851,067 | A * | 12/1998 | Fleischli | B01F 5/0617 | 366/337 |
| 6,217,208 | B1 * | 4/2001 | Schuchardt | B01F 5/061 | 366/147 |
| 6,394,644 | B1 * | 5/2002 | Streiff | B01F 5/0613 | 366/337 |
| 6,412,975 | B1 * | 7/2002 | Schuchardt | F28D 7/0058 | 165/148 |
| 8,062,518 | B2 * | 11/2011 | Hanna | B01F 1/0033 | 210/205 |
| 8,646,758 | B2 * | 2/2014 | Raynal | B01J 19/32 | 261/112.2 |
| 8,684,593 | B2 * | 4/2014 | Moser | B01F 5/0451 | 366/336 |
| 8,939,638 | B2 * | 1/2015 | Palmer | B01F 5/0473 | 366/337 |
| 2003/0165080 | A1 * | 9/2003 | Pinyayev | B01F 5/0619 | 366/337 |
| 2009/0103393 | A1 | 4/2009 | Moser et al. | | |
| 2012/0134232 | A1 | 5/2012 | Schneider | | |

* cited by examiner

CHANNEL MIXING APPARATUS

TECHNICAL FIELD

The present invention relates generally to material distributing and mixing apparatus and particularly to stationary material distribution and mixing apparatus which can be installed within a suitable conduit carrying fluids to be mixed on site as well as the method for employing the stationary material distribution and mixing apparatus for the introduction and mixing of an additive into a moving fluid stream

BACKGROUND OF THE INVENTION

Applicant has long ago recognized the desirability of providing a superior line of motionless mixers, that is, mixing elements which do not rely upon any moving parts to create an enhance the mixing operation. Motionless or static mixers generally operate on the principal of creating velocity vectors, increasing the contact area between fluids to be mixed and/or splitting a fluid stream into subparts and then recombining the subparts all to enhance the mixing of fluids in a conduit.

One area that is ideally suited to the application of static mixers is in water treatment Additives, such as chlorine, can be introduced and uniformly dispersed into an aqueous fluid stream using such devices. This environment deals with relatively low viscosity liquids and the introduction of additives in low concentrations which, again, is an ideal environment for mixers of the type described herein In this regard, reference is made to FIG. 1.

FIG. 1 is directed to a previous designed stationary material mixing and distribution apparatus employed by applicant for water treatment applications. The apparatus is generally employed by nesting four individual mixing and distribution devices in a square or rectangular array. Specifically, stationary material mixing and distribution apparatus 10 is shown composed of four sub-conduits although the number of sub-conduits can vary depending upon application. Each sub conduit is composed of sidewalls 12 and 14 which are substantially parallel to one another and are orthogonal to the bottom 15 and top 26 The conduit has open ends 12 and 14 to enable a fluid, such as water to travel through the conduit in the direction of arrows 19. As fluid flows through the conduit, additive is introduced via vertically oriented tubes 16 having a plurality of additive ports 17 such that additive flows in the direction of arrows 18. Upon doing so, the main fluid and additive confront diagonally oriented baffles 21, 22 and 23, which are impacted by fluids flowing in the direction of arrows 18 and 19, resulting in turbulent redirection of such fluid flow resulting in mixing while being mindful of any pressure drop related thereto. Although such a configuration has proven to be successful, it is now determined that more efficient mixing can be achieved at minimal pressure drops to which the present invention is directed It is thus an object of the present invention to provide a stationary material mixing and distribution apparatus which is more efficient than similar devices of the prior art and at very low pressure drops It is yet a further object of the present invention to teach an element for use in a stationary material mixing and distribution device which greatly enhances mixing, particularly in aqueous and low viscosity fluid streams ideally suited in water treatment facilities.

These and further objects will be readily apparent when considering the following disclosure and appended claims.

SUMMARY OF THE INVENTION

An element for use in a stationary material mixing and distribution apparatus comprising an article of manufacture having a pair of forward facing V-sections, each forward facing V-section comprising a pail of substantially rectangular forward facing legs, each substantially rectangular forward facing leg having a first end and a second end, the first ends of each pair of said substantially rectangular forward facing legs being joined to one another forming a forward facing vertically oriented apex and a pair of rearward facing V-sections, each rearward facing V-section comprising a pair of substantially rectangular rearward facing legs, each substantially rectangular rearward facing leg having a first end and a second end, each first end of said substantially rectangular rearward facing leg being appended to a second end of a substantially rectangular forward facing leg, and the second ends of each pair of said substantially rectangular rearward facing legs being joined to one another forming a rearward facing horizontally oriented apex A stationary material mixing and distribution apparatus comprising a conduit, said conduit having a fluid inlet and fluid outlet, an element positioned between said fluid inlet and fluid outlet, said element comprising an article of manufacture having a pair of forward facing V-sections, each forward facing V-section comprising a pair of substantially rectangular forward facing legs, each substantially rectangular forward facing leg having a first end and a second end, the first ends of each pair of said substantially rectangular forward facing legs being joined to one another forming a forward facing vertically oriented apex and a pair of rearward facing V-sections, each rearward facing V-section comprising a pair of substantially rectangular rearward facing legs, each substantially rectangular rearward facing leg having a first end and a second end, each first end of said substantially rectangular rearward facing leg being appended to a second end of a substantially rectangular forward facing leg, and the second ends of each pair of said substantially rectangular rearward facing legs being joined to one another forming a rearward facing horizontally oriented apex.

A method of mixing and distributing an additive into a moving fluid stream passing within a conduit, said conduit having a fluid inlet end and fluid outlet end, said method comprising positioning an element between said fluid inlet and fluid outlet, said element comprising an article of manufacture having a pair of forward facing V-sections, each forward facing V-section comprising a pair of substantially rectangular forward facing legs, each substantially rectangular forward facing leg having a first end and a second end, the first ends of each pair of said substantially rectangular forward facing legs being joined to one another forming a forward facing vertically oriented apex and a pair of rearward facing V-sections, each rearward facing V-section comprising a pair of substantially rectangular rearward facing legs, each substantially rectangular rearward facing leg having a first end and a second end, each first end of said substantially rectangular rearward facing leg being appended to a second end of a substantially rectangular forward facing leg, and the second ends of each pair of said substantially rectangular rearward facing legs being joined to one another forming a rearward facing horizontally oriented apex, positioning a plurality of additive ports at said fluid inlet end, upstream of said element, passing fluid through said conduit while introducing additive through said plurality of additive ports

DETAILED DESCRIPTION OF THE INVENTION

Figure 1:
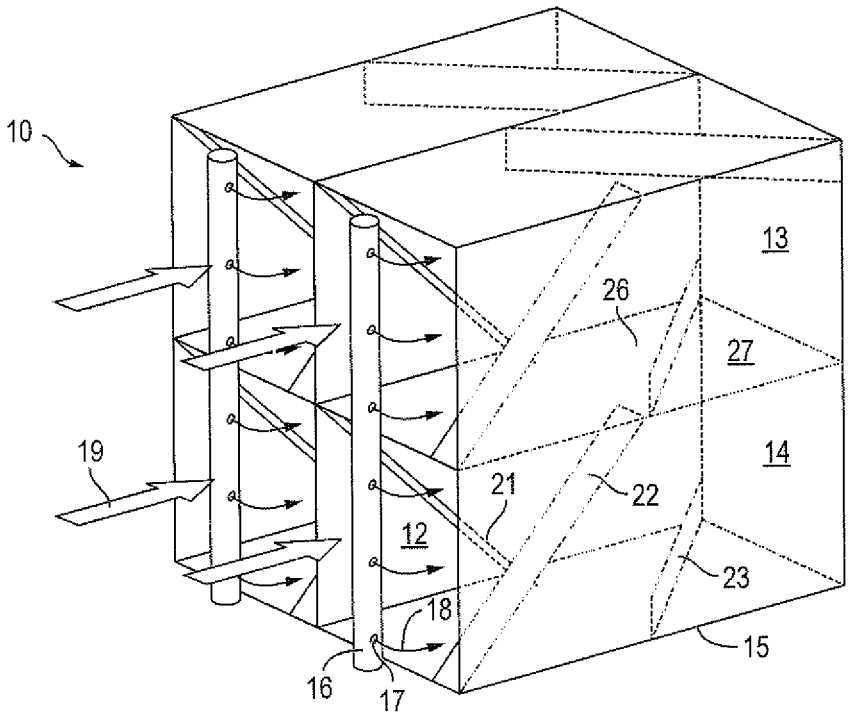
FIG. 1 (PRIOR ART)
FIG. 1 is a perspective view of a stationary material mixing and distribution apparatus of the prior art.

Novel features which are characteristic of the invention, as to organization and method of operation, together with further objects and advantages thereof will be better understood from the following description considered in connection with the accompanying drawings, in which preferred embodiments of the invention are illustrated by way of example It is to be expressly understood, however, that the drawings are for illustration description only and are not intended as definitions of the limits of the invention. The various features of novelty which characterize the invention are recited with particularity in the claims There has been broadly outlined more important features of the invention in the summary above and in order that the detailed description which follows may be better understood, and in order that the present contribution to the art may be appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important therefore, that claims be regarded as including such equivalent constructions insofar as they do not depart from the spirit and scope of the present invention.

Certain terminology and the derivations thereof may be used in the following description for convenience and reference only, and will not be limiting. For example, words such as "upward," "downward," "left," and "right" refer to directions in the drawings to which reference is made unless otherwise stated. Similar words such as "inward" and "outward" refer to directions toward and away from, respectively, the geometric center of a device or area and designated parts thereof Reference in the singular tense include the plural and vice versa, unless otherwise noted.

Figure 2:
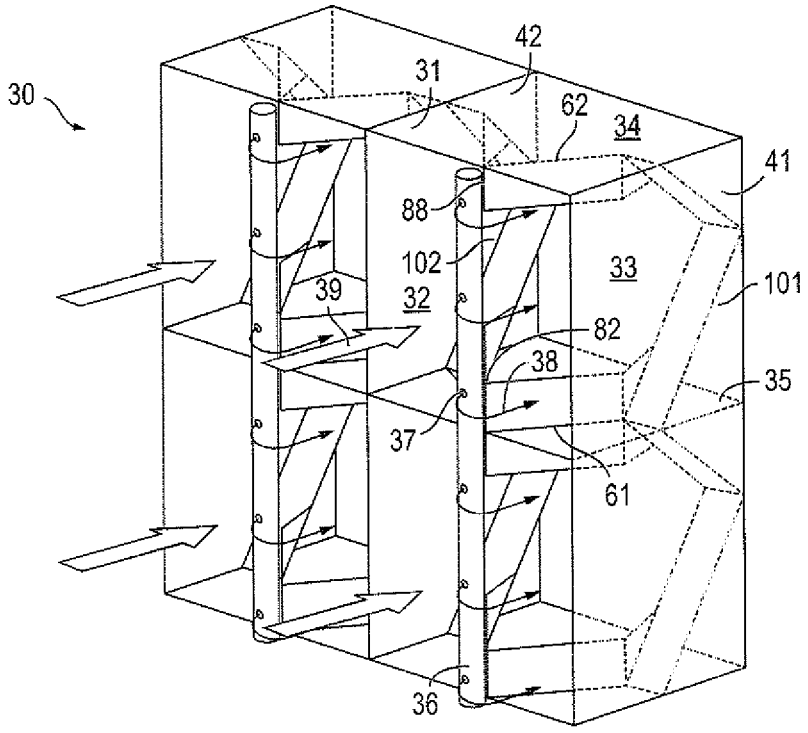
FIG. 2 is a perspective view of a stationary material mixing and distribution apparatus of the present invention.
Figure 3:
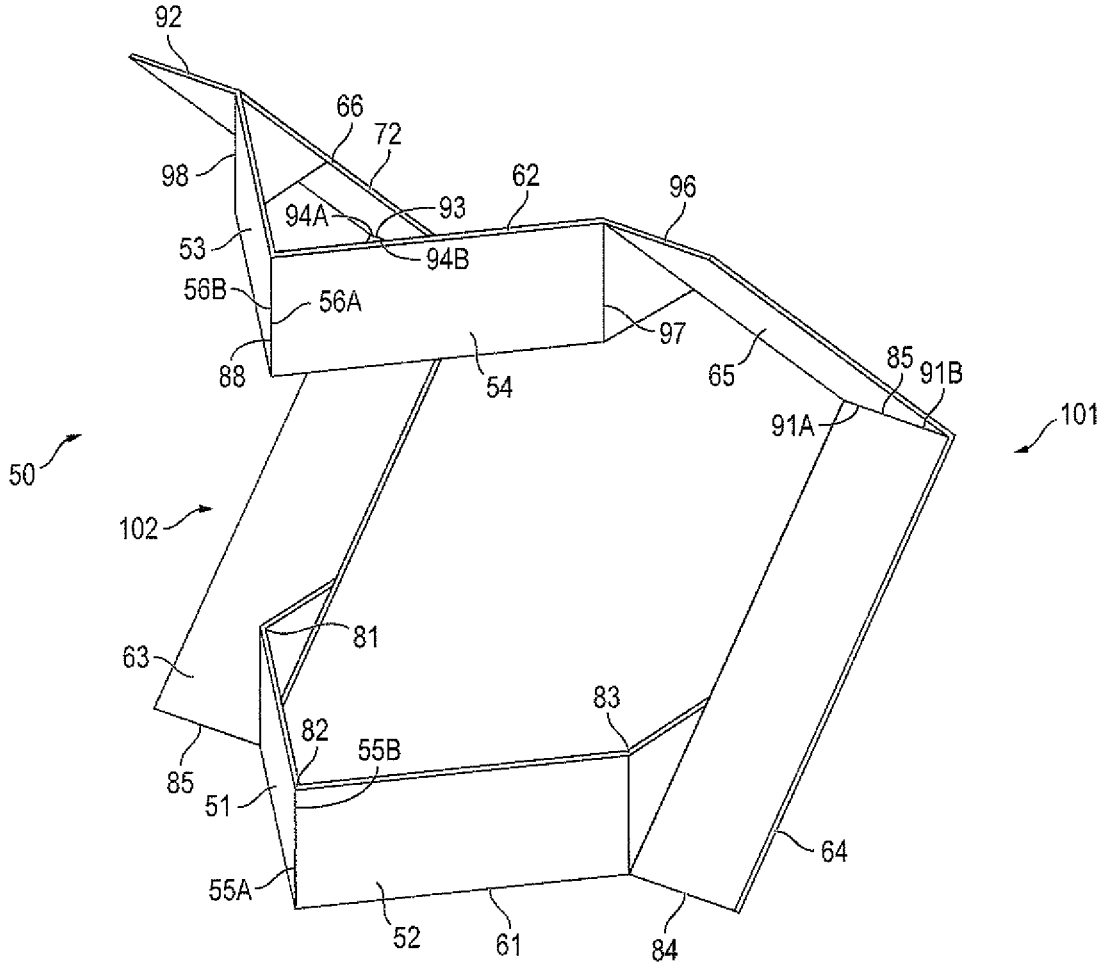
FIG. 3 is a perspective view of an element for use in the stationary material mixing and distribution apparatus as depicted in FIG. 2.

Turning first to FIG. 3, element 50 is depicted which is employed in the present stationary material mixing and distribution apparatus such as that illustrated in FIG. 2. Specifically, element 50 comprises a pair of forward facing V-sections 61 and 62, each forward facing V-section comprising a pair of substantially rectangular forward facing legs 51, 52, 53 and 54, respectively. Each substantially rectangular forward facing leg 51, 52, 53 and 54 are characterized as having first ends 55A, 55B and 56A and 56B and second ends 81, 83, 97 and 98. As illustrated, each pair of substantially rectangular forward facing legs 51, 52, 53 and 54 are joined to one another at their first ends forming vertically oriented apexes 82 and 88 which, in operation, face incoming fluid (in the direction of arrows 39) and direct the fluid from the midline of the conduit toward its edges. Element 50 is further characterized as having a pair of rearward facing V-sections 101 and 102 Rearward facing V-sections comprise a pair of substantially rectangular rearward facing legs 63, 64, 65 and 66, the substantially rectangular rearward facing legs having first ends 84, 85, 92 and 96 each of which are appended to second ends 81, 83, 97 and 98 of the substantially rectangular forward facing legs and have second ends 91A, 91B, 94A and 94B being joined to one another in pairs forming rearward facing horizontally oriented apexes 85 and 93

In turning to FIG. 2, array 30 of four conduits each housing element 50 is illustrated For the sake of simplicity, only the upper right conduit of FIG. 2 will be discussed. Element 50 is positioned within the conduit, the conduit being substantially square or rectangular in cross-section having an open fluid inlet 32 and outlet 34 for the passage of a fluid stream in the direction of arrows 39 there through. When mixing element 50 is installed within conduit 30, forward facing V-sections 61 and 62 are parallel to and adjacent to the top and bottom walls 31 and 35. Also, rearward facing V-sections 101 and 102 are parallel to and adjacent to sidewalls 41 and 42. As noted, the apexes of the forward facing V-sections are oriented vertically while the apexes of the rearward facing V-sections are oriented horizontally.

A series of additive ports 37 are configured within vertically oriented additive feed tube 36, additive feed tube 36 being positioned proximate forward facing vertically oriented apexes 82 and 88 such that additive is introduced in the direction of arrows 38 while impacting forward facing V-sections 61 and 62 together with fluid flowing in the direction of arrows 39 and are thus diverted towards sidewalls 41 and 42 proximate top and bottom walls 31 and 35 while rearward facing V-sections 101 and 102 cause the fluid to move away from top and bottom walls 31 and 35 and proximity to sidewalls 41 and 42 These complex vectors result in impressively efficient mixing at comparably low pressure drops.

The above disclosure is sufficient to enable one of ordinary skill in the art to practice the invention, and provides the best mode of practicing the invention presently contemplated by the inventor. While there is provided herein a full and complete disclosure of the preferred embodiments of the invention, it is not desired to limit the invention to the exact construction, dimensions, relationships, or operations as described. Various modifications, alternative constructions, changes and equivalents will readily occur to those skilled in the art and may be employed as suitable without departing from the true spirit and scope of the invention. Such changes might involve alternative materials, components, structural arrangements, sizes, shapes, forms, functions, operational features or the like. Therefore, the above description and illustration should not be considered as limiting the scope of the invention, which is defined by the appended claims.

What is claimed is:

1. An element for use in a stationary material mixing and distribution apparatus comprising an article of manufacture having a pair of forward facing V-sections, each forward facing V-section comprising a pair of substantially rectangular forward facing legs, each substantially rectangular forward facing leg having a first end and a second end, the first ends of each pair of said substantially rectangular forward facing legs being joined to one another forming a forward facing vertically oriented apex and a pair of rearward facing V-sections, each rearward facing V-section comprising a pair of substantially rectangular rearward facing legs, each substantially rectangular rearward facing leg having a first end and a second end, each first end of each said substantially rectangular rearward facing leg being appended to a second end of a said substantially rectangular forward facing leg, and the second ends of each pair of said substantially rectangular rearward facing legs being joined to one another forming a rearward facing horizontally oriented apex.

2. A stationary material mixing and distribution apparatus comprising a conduit, said conduit having a fluid inlet and fluid outlet, an element positioned between said fluid inlet and fluid outlet, said element comprising an article of manufacture having a pair of forward facing V-sections, each forward facing V-section comprising a pair of substantially rectangular forward facing legs, each substantially rectangular forward facing leg having a first end and a second end, the first ends of each pair of said substantially rectangular forward facing legs being joined to one another forming a forward facing vertically oriented apex, and a pair of rearward facing V-sections, each rearward facing V-section comprising a pair of substantially rectangular rearward facing legs, each substantially rectangular rearward facing leg having a first end and a second end, each first end of each said substantially rectangular rearward facing leg being appended to a second end of a said substantially rectangular forward facing leg, and the second ends of each pair of said substantially rectangular rearward facing legs being joined to one another forming a rearward facing horizontally oriented apex.

3. The stationary material mixing and distribution apparatus of claim 2 further comprising a plurality of additive ports positioned at said fluid inlet, upstream of said element.

4. The stationary material mixing and distribution apparatus of claim 3 wherein said plurality of additive ports are configured within a vertically oriented additive feed tube, said additive feed tube being positioned proximate said forward facing vertically oriented apexes of said forward facing V-sections.

5. The stationary material mixing and distribution apparatus of claim 4 wherein said conduit is square or rectangular in cross-section having an open fluid inlet and open fluid outlet, parallel bottom and top walls and parallel side walls, said side walls being orthogonal to said bottom and top walls.

6. The stationary material mixing and distribution apparatus of claim 5 wherein each rearward facing V-section is parallel to and adjacent to one of said side walls of said conduit.

7. The stationary material mixing and distribution apparatus of claim 5 wherein each forward facing V-section is parallel to and adjacent to a top or bottom wall of said conduit.

* * * * *